US011185761B2

(12) United States Patent
Jackson

(10) Patent No.: US 11,185,761 B2
(45) Date of Patent: Nov. 30, 2021

(54) INSTANT GAME TICKET WITH STICKER ENHANCEMENT

(71) Applicant: Kathleen Nylund Jackson, Newport, NC (US)

(72) Inventor: Kathleen Nylund Jackson, Newport, NC (US)

( * ) Notice: Subject to any disclaimer, the term of this patent is extended or adjusted under 35 U.S.C. 154(b) by 204 days.

(21) Appl. No.: 16/665,262

(22) Filed: Oct. 28, 2019

(65) Prior Publication Data

US 2020/0054935 A1 Feb. 20, 2020

(51) Int. Cl.

| | |
|---|---|
| ***A63F 3/06*** | (2006.01) |
| ***G07F 17/32*** | (2006.01) |
| ***G07C 15/00*** | (2006.01) |
| *A63F 9/24* | (2006.01) |

(52) U.S. Cl.

CPC ..... *A63F 3/0665* (2013.01); *A63F 3/069* (2013.01); *A63F 3/0645* (2013.01); *G07C 15/005* (2013.01); *G07F 17/329* (2013.01); *A63F 2009/242* (2013.01)

(58) Field of Classification Search

CPC ..... A63F 3/0665; A63F 3/0645; A63F 3/069; A63F 2009/242; G07F 17/329; G07C 15/005

See application file for complete search history.

(56) References Cited

U.S. PATENT DOCUMENTS

| | | | | |
|---|---|---|---|---|
| 5,002,313 | A | 3/1991 | Salvatore | |
| 5,046,737 | A | 9/1991 | Feinberg | |
| 5,074,566 | A | 12/1991 | Desbiens | |
| 5,092,598 | A | 3/1992 | Kamille | |
| 5,118,100 | A | 6/1992 | Gremina | |
| 5,158,293 | A | 10/1992 | Mullins | |
| 5,193,815 | A | 3/1993 | Pollard | |
| 5,407,200 | A | 4/1995 | Zalabak | |
| 5,494,317 | A | 2/1996 | Johnson | |
| 5,531,482 | A * | 7/1996 | Blank | B42D 15/0053 156/701 |
| 5,657,991 | A | 8/1997 | Camarato | |
| 5,743,524 | A | 4/1998 | Nannicola | |
| 5,909,875 | A | 6/1999 | Weingardt | |
| 5,934,671 | A | 8/1999 | Harrison | |
| 6,217,078 | B1 * | 4/2001 | Roth | G09F 3/02 283/101 |
| 6,224,055 | B1 * | 5/2001 | Walker | A63F 3/0665 273/139 |
| 6,241,246 | B1 | 6/2001 | Guttin et al. | |
| 6,250,685 | B1 | 6/2001 | Walker et al. | |
| 6,588,747 | B1 | 7/2003 | Seelig | |
| 6,612,576 | B1 | 9/2003 | Stancik et al. | |
| 6,698,755 | B2 | 3/2004 | Cherry | |
| 6,761,633 | B2 | 7/2004 | Riendeau et al. | |
| 6,889,978 | B2 | 5/2005 | Schaefer et al. | |
| 6,918,589 | B2 | 7/2005 | Thibault | |
| 6,926,273 | B1 | 8/2005 | Vancura | |
| 7,004,506 | B2 | 2/2006 | Downes et al. | |
| 7,396,015 | B2 | 7/2008 | Feola | |
| 7,410,168 | B2 | 8/2008 | Gumina | |

(Continued)

*Primary Examiner* — Thomas J Hong
*Assistant Examiner* — Carl V Larsen

(57) ABSTRACT

An instant lottery scratch ticket and method of playing a lottery instant scratch ticket game comprises a plurality of physical tickets, wherein each ticket provides a removable sticker that may provide wins or enhanced wins.

29 Claims, 15 Drawing Sheets

(56) References Cited

U.S. PATENT DOCUMENTS

| | | | |
|---|---|---|---|
| 7,429,044 | B2 | 9/2008 | O'Brien |
| 7,481,432 | B2 | 1/2009 | Feola |
| 7,497,778 | B2 | 3/2009 | Bozeman |
| 7,510,116 | B2 | 3/2009 | Robb et al. |
| 7,530,570 | B2 | 5/2009 | Nulph et al. |
| 7,959,188 | B2 | 6/2011 | Martineck |
| 7,980,559 | B2 | 7/2011 | Miller et al. |
| 8,231,449 | B2 | 7/2012 | Martineck, Sr. |
| 8,262,461 | B2 | 9/2012 | Frick |
| 8,298,063 | B2 | 10/2012 | Packes et al. |
| 8,333,380 | B2 | 12/2012 | Berkowitz |
| 8,512,123 | B2 | 8/2013 | Stanek et al. |
| 8,523,078 | B2 | 9/2013 | Biskupski |
| 8,579,693 | B2 | 11/2013 | Bennett, III et al. |
| 8,628,082 | B2 | 1/2014 | Martineck |
| 8,672,325 | B2 | 3/2014 | Green |
| 8,864,565 | B2 | 10/2014 | Packes et al. |
| 2002/0130464 | A1 | 9/2002 | Taylor et al. |
| 2005/0148379 | A1 | 7/2005 | Huard et al. |
| 2006/0252488 | A1 | 11/2006 | LaLonde et al. |
| 2006/0273520 | A1* | 12/2006 | McDonald ..... A63F 3/0665 273/292 |
| 2006/0287055 | A1 | 12/2006 | Hamud |
| 2007/0021186 | A1 | 1/2007 | Hamud |
| 2007/0187888 | A1 | 8/2007 | Dures et al. |
| 2009/0098922 | A1 | 4/2009 | Cummings et al. |
| 2009/0121425 | A1* | 5/2009 | Berkowitz ..... A63F 3/0665 273/139 |
| 2009/0224528 | A1* | 9/2009 | Kim ..... G09F 3/10 283/72 |
| 2009/0253481 | A1 | 10/2009 | Honour |
| 2009/0287580 | A1* | 11/2009 | Irwin, Jr. ..... G06Q 30/0283 705/21 |
| 2009/0309352 | A1* | 12/2009 | Walker ..... G07F 17/329 283/100 |
| 2010/0144417 | A1 | 6/2010 | Wright et al. |
| 2011/0281637 | A1 | 11/2011 | Meyer et al. |
| 2012/0289302 | A1 | 11/2012 | Martinez |
| 2013/0324212 | A1 | 12/2013 | Frick et al. |
| 2014/0246849 | A1 | 9/2014 | Frost |
| 2014/0274275 | A1 | 9/2014 | DeFrance et al. |

* cited by examiner

INSTANT GAME TICKET WITH STICKER ENHANCEMENT

BACKGROUND OF THE INVENTION

1. Field of the Invention

The present invention relates to an instant game ticket (otherwise known in the art as a "scratch ticket"). The invention further relates to lottery gaming wherein the physical instant game ticket may be purchased and verified at a lottery agent location or other suitable locations, the ticket providing a removable sticker that may provide a winning result or an enhanced winning result.

2. Background of the Art

For nearly 50 years, instant game tickets, or scratch tickets as in known in the art, have been offered for sale as part of city, state, and national lotteries. These tickets typically have an array of winning numbers and an array of player numbers, each concealed with a removable film. The player scratches off the film to reveal the numbers. If a player number matches a winning number, a prize is won.

Scratch ticket games are provided wherein a predetermined number of tickets are printed, each ticket providing either a losing result or a winning result. The amount of tickets with losing results is predetermined, as are the number of tickets with winning results. Also predetermined is the number of tickets for each individual win amount. The total amount of awards of the winning tickets will be less than the total cost of all tickets in the game. For instance, a total of 90,720,000 $5 tickets may be printed and sold. The total ticket sales will be $453,600,000. The total payout to players may be $345,471,000.

Scratch tickets (otherwise known as instant tickets or scratchers) have gained considerable popularity since they provide a near instant gratification; that is, the result can be determined in mere seconds. More recently, scratch tickets have been designed with more gameplay and extended play time. Many players are dedicated to the extended play tickets due to the increased anticipation that longer play time provides.

In order to keep the incentive to play fresh and appealing, new versions of the instant ticket have been created. Various attempts have been made to create new instant games and gameplay in order to increase player participation and excitement.

U.S. Pat. No. 8,512,123 (Stanek, et al.) teaches a method and associated lottery game card/ticket for implementing a ticket-based, multi-component lottery game and includes providing lottery tickets for players, wherein the lottery tickets include a first game component with a first prize structure and at least one additional game component with a separate second prize structure. A first validation code is provided on the lottery ticket that is linked to a first game server for validating and redeeming the first game component of the lottery ticket. A second validation code is provided on the lottery ticket that may be linked to a separate second game server for validating and redeeming the second game component of the lottery ticket. Validation and redemption of the lottery ticket for the first and second game components is enabled by separate redemption acts.

U.S. Pat. No. 7,980,559 (Miller, et al.) teaches a lottery ticket having a play area containing rows and columns defining individual play spaces with up to all of the play spaces containing a play symbol and at least one line connecting a plurality of play spaces wherein a prize may be won if the line connects at least two preselected play symbols.

U.S. Pat. No. 8,298,063 (Packes, et al.) discloses some systems, processes, apparatus and articles of manufacture that provide for selling lottery entries. In one example, a request is received to purchase a multiplier and a set of play indicia for a lottery game.

U.S. Pat. No. 8,523,078 (Biskupski) discloses a card that may have a card substrate having at least a surface, the surface including at least predetermined information to be concealed provided thereon, and a dual scratch and peel label provided on the card substrate over the predetermined information, the dual scratch and peel label including at least: (i) a first base film adhered to the card substrate over the at predetermined information; (ii) a second base film releasably adhered over the first base film; and (iii) a scratch-off surface applied over the second base film, the scratch-off surface being configured to conceal the predetermined information provided on the card substrate.

U.S. Pat. No. 6,918,589 (Thibault) describes a lottery type game system, method and ticket, wherein the winning of a game is determined by the assignment of game images to a predetermined number of consecutive positions along a linear array. The value of the prize is determined by the precise position along the linear array at which this predetermined number of game images are assigned. The assignment of the position of a game image can be established by: a) matching a game image associated with a particular gaming piece with an identical image located at a predetermined position along the linear array; or b) receiving a game piece upon which both the game image and the assigned position of the game image along the array is indicated.

U.S. Pat. No. 8,628,082 (Martineck) describes a lottery instant-game ticket and method of making same. On a substrate is placed a first set of game indicia including a first set of game symbols, and a second set of indicia larger than the first set of game indicia and including a second set of game symbols, and includes any winning symbol. A subset of the second set of game indicia with each symbol includes a non-winning indicator. The first set and second of game indicia are covered with a removable covering, with the covering having position indicators positioned substantially over each of the first set of game indicia, and identical game symbols positioned substantially over a corresponding identical game symbol of the second set of game indicia such that removal of the identical game symbol reveals the identical game symbol of the second set of game indicia and any non-winning indicator, if present.

Each of the references discussed in this text art are incorporated herein in their entirety for all purposes.

It is an ever-increasing challenge to provide players with new and enticing gameplay features that will stimulate player interest and increase participation in instant lottery games. It would be advantageous to provide inventive elements for an instant scratch ticket that provide the player with the ability to interact with the ticket, thus providing an illusion of skill or control.

SUMMARY OF THE INVENTION

The present invention discloses a lottery ticket and game in which a plurality of instant scratch tickets is provided. At least one array of game symbols from a predetermined set of game symbols is provided, and at least one array of game symbols is covered with a removable film. Some to all of the removable film is scratched off, and at least two game symbols are compared for wins. At least one removable sticker is provided on the ticket, and is preferably covered with an opaque removable film. The opaque removable film on the sticker(s) is scratched off, revealing at least one sticker symbol on the at least one sticker. The at least one sticker is removed from the ticket, and placed in a sticker placement box on the ticket. The sticker acts to provide a losing result, a winning result or an enhanced winning result.

DETAILED DESCRIPTION OF THE INVENTION

Figure 1A:
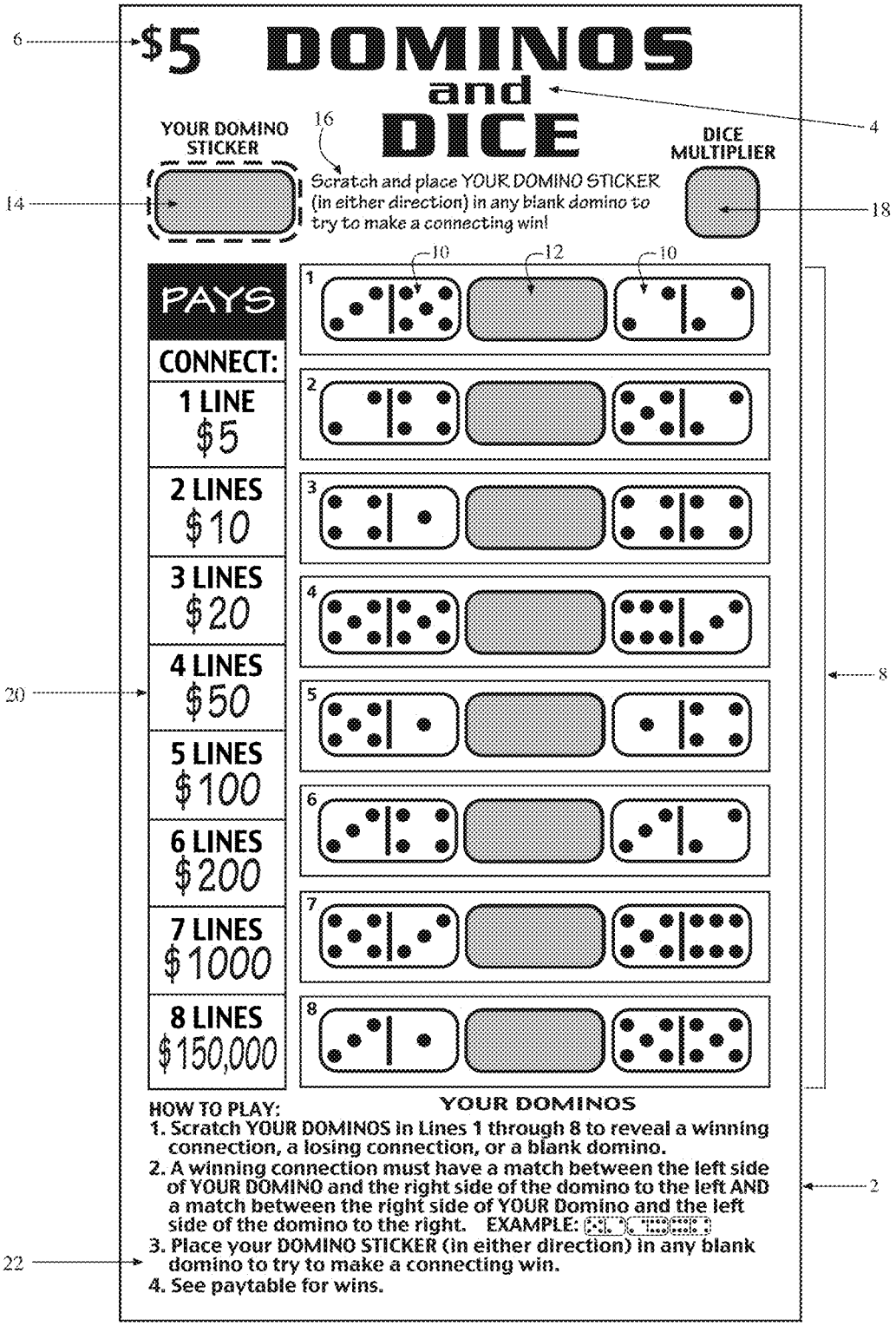
FIG. 1A shows an initial instant scratch ticket containing the game elements for a game utilizing the game technology described in a first preferred embodiment of the present invention herein.

A first preferred embodiment of the present invention describes an instant lottery ticket and method of conducting a lottery instant scratch ticket game that comprises: a) providing a plurality of physical scratch tickets that are printed on a card; b) providing an array of game symbols on the ticket card from a predetermined set of game symbols as play symbols; c) providing an array of game symbols on the ticket card from the predetermined set of game symbols as player symbols, wherein the player symbols may be provided within blank player spaces and wherein predetermined player symbols interact with predetermined play symbols; d) concealing the player spaces with an opaque removable film; e) providing at least one removable sticker on the ticket; f) providing at least one player symbol on the at least one removable sticker; g) concealing the at least one removable sticker with an opaque removable film; h) removing the opaque removable film concealing the player spaces to reveal either a player symbol or a blank player space; i) providing an explanation of a specific interaction between a revealed player symbol on the card and the play symbols; j) determining a prize if the said specific interaction between a revealed player symbol on the card and a play symbol is present; k) removing the opaque removable film concealing the at least one sticker to reveal the player symbol(s); l) placing the at least one sticker revealing a player symbol in any one revealed blank player space(s); m) providing an explanation of a specific interaction between a revealed player symbol on the sticker and the play symbols; n) determining a prize if the said specific interaction between a revealed player symbol on the sticker and a play symbol is present; and o) providing any prizes based on the specific interaction between a player symbol on the card and the play symbols and/or the specific interaction between a player symbol on the sticker and the play symbols.

In an exemplary first preferred embodiment of the present invention, a lottery game is disclosed in which a plurality of instant scratch tickets is provided. A wager of cash, credits or non-monetary points may be required to play the game. The name of the game is shown on the ticket. Preferably, a printed verification code is provided and is concealed underneath an opaque film. The said verification code provides an encryption that guarantees that the ticket is valid and maintains the authenticity of the instant game ticket. The price of the ticket and instructions on how to play the game are provided.

A predetermined set of game symbols is provided, the game symbols comprising dominos wherein each domino comprises a left side providing 1 through 6 "pips" and a right side providing 1 through 6 "pips". An array of play symbols from the set of game symbols is provided wherein two dominos are provided horizontally in each of a predetermined amount of separate play areas (herein called "game lines"). An array of player spaces is provided so that there is one player space disposed horizontally between the two domino play symbols in each game line. The player spaces are concealed by an opaque removable film. The opaque removable film is scratched off of each player space, revealing either a player symbol domino from the set of game symbols, or a blank player space. The player symbol domino and the adjoining play symbol dominos in each game line interact and are compared as follows: the left side of the player symbol domino is compared with the right side of the left-hand play symbol domino, and the right side of the player symbol domino is compared with the left side of the right-hand play symbol domino. If both sides of the player symbol domino match the adjoining play symbol dominos, the game line is a winning line. If both sides of the player symbol domino do not match the adjoining play symbol dominos, the game line is not a winning line.

At least one sticker is provided on the instant ticket and concealed by an opaque removable film. In this said first exemplary embodiment of the present invention, one sticker is provided, although it is contemplated that more than one sticker may be provided. The sticker comprises one domino game symbol, and is herein described as a player symbol domino sticker. The said player symbol domino sticker preferably has a security code or feature that prevents player tampering by utilizing a sticker from a separate ticket or printing a bogus sticker. It is also contemplated that a copy of the player symbol on the sticker may be printed on the card beneath the sticker to ensure that the sticker has not been altered. The opaque film concealing the domino game symbol on the sticker is scratched off, and if at least one blank player space has been provided in the game lines, the revealed player symbol domino sticker may be placed in one blank player space in order to try to achieve a winning result. The player symbol domino sticker may be placed either in a 0° angle disposition or rotated 180° angle disposition. If both sides of the player symbol domino sticker match the adjoining play symbol dominos, the game line is a winning line. A predetermined paytable is provided, wherein the amount of winning game lines determine the prize. Any wins according to the paytable are awarded to the player.

A multiplier dice symbol may be provided as a multiplier of 1×, 2×, 3×, 4×, 5× or 6× for any wins. The dice symbol is initially concealed by an opaque removable film, and when scratched off, the multiplier is revealed.

A second preferred embodiment of the present invention describes an instant lottery ticket and method of conducting a lottery instant scratch ticket game that comprises: a) providing a plurality of physical scratch tickets that are printed on a card; b) providing an array of winning game symbols on the ticket card from a predetermined set of game symbols; c) providing an array of player symbols on the ticket card from the predetermined set of game symbols; d) concealing the winning game symbols with an opaque removable film; e) concealing the player symbols with an opaque removable film; f) providing at least one removable sticker on the ticket; g) providing a multiplier symbol from a predetermined set of multiplier symbols on the at least one removable sticker as a multiplier sticker; h) concealing the at least one multiplier sticker with an opaque removable film; i) removing the opaque removable film concealing the winning game symbols to reveal the winning game symbols; j) removing the opaque removable film concealing the player symbols to reveal the player symbols; k) determining a prize if a winning game symbol matches a player symbol; l) providing at least one sticker placement box; m) providing a predetermined amount of player symbols associated with each sticker placement box so that each sticker placement box is associated with a like amount of player symbols; n) removing the opaque removable film concealing the at least one multiplier sticker to reveal the multiplier symbol(s); o) placing the at least one sticker revealing a multiplier symbol in a sticker placement box; p) determining an enhanced prize if the placed sticker is associated with a winning player symbol; and q) providing any prizes based on the winning player symbol(s) and the multiplier sticker(s).

In an exemplary second preferred embodiment of the present invention, a lottery game is disclosed in which a plurality of instant scratch tickets is provided. A wager of cash, credits or non-monetary points may be required to play the game. The name of the game is shown on the ticket. Preferably, a printed verification code is provided and is concealed underneath an opaque film. The said verification code provides an encryption that guarantees that the ticket is valid and maintains the authenticity of the instant game ticket. The price of the ticket and instructions on how to play the game are provided.

An array of winning numbers from a predetermined set of numbers and an array of player numbers from the predetermined set of numbers are provided and concealed by an opaque removable film. A predetermined amount of sticker placement boxes is provided, each sticker box comprising a different multiplier from a predetermined set of multiplier symbols. For example, a first sticker placement box may indicate a 2× multiplier sticker may be placed within, a second sticker placement box may indicate a 3× multiplier sticker may be placed within, a third sticker placement box may indicate a 5× multiplier sticker may be placed within, a fourth sticker placement box may indicate a 10× multiplier sticker may be placed within, and a fifth sticker placement box may indicate a 20× multiplier sticker may be placed within. Each sticker placement box is associated with a predetermined like amount of player numbers. The opaque removable film is scratched off, revealing the winning numbers and the player numbers. Any player number that matches a winning number provides a prize.

At least one sticker is provided on the instant ticket and concealed by an opaque removable film. In this said second exemplary embodiment of the present invention, one sticker is provided, although it is contemplated that more than one sticker may be provided. The sticker comprises one multiplier symbol from the said predetermined set of multiplier symbols, and is herein described as a multiplier sticker. The said multiplier sticker preferably has a security code or feature that prevents player tampering by utilizing a sticker from a separate ticket or printing a bogus sticker. It is also contemplated that a copy of the player symbol on the sticker may be printed on the card beneath the sticker to ensure that the sticker has not been altered. The opaque film concealing the multiplier symbol on the sticker is scratched off, revealing the multiplier. The multiplier sticker is then placed in its associated sticker placement box. If a player number that is a win is associated with the multiplier sticker, the prize is multiplied accordingly.

A third preferred embodiment of the present invention describes an instant lottery ticket and method of conducting a lottery instant scratch ticket game that comprises: a) providing a plurality of physical scratch tickets that are printed on a card; b) providing an array of winning game numbers on the ticket card from a predetermined set of numerical game symbols; c) providing an array of player numbers on the ticket card from the predetermined set of numerical game symbols; d) concealing the winning game numbers with an opaque removable film; e) concealing the player numbers with an opaque removable film; f) providing at least one removable sticker on the ticket as a player sticker; g) providing a modifying numerical symbol from a predetermined set of modifying numerical symbols on the player sticker; h) concealing the at least one player sticker with an opaque removable film; i) removing the opaque removable film concealing the winning game numbers to reveal the winning game numbers; j) removing the opaque removable film concealing the player numbers to reveal the player numbers; k) determining a prize if a winning game number matches a player number; l) providing one sticker placement box for each of the winning game numbers wherein the winning game number is modified by the player sticker; m) removing the opaque removable film concealing the at least one player sticker to reveal the modifying numerical symbol; n) placing the at least one player sticker in any sticker placement box wherein the winning game number is modified by the player sticker; o) determining a prize if the modified winning game number matches a player number; and p) providing any prizes based on the winning player number(s) and the player numbers and/or a modified winning game number and a player number.

In an exemplary third preferred embodiment of the present invention, a lottery game is disclosed in which a plurality of instant scratch tickets is provided. A wager of cash, credits or non-monetary points may be required to play the game. The name of the game is shown on the ticket. Preferably, a printed verification code is provided and is concealed underneath an opaque film. The said verification code provides an encryption that guarantees that the ticket is valid and maintains the authenticity of the instant game ticket. The price of the ticket and instructions on how to play the game are provided.

An array of winning numbers from a predetermined set of game numbers and an array of player numbers from the predetermined set of game numbers are provided and concealed by an opaque removable film. A sticker placement box is provided, each sticker box associated with a winning number. The opaque removable film is scratched off, revealing the winning numbers and the player numbers. Any player number that matches a winning number provides a prize.

At least one sticker is provided on the instant ticket and concealed by an opaque removable film. In this said third exemplary embodiment of the present invention, one sticker is provided, although it is contemplated that more than one sticker may be provided. The sticker comprises one modifier symbol from a predetermined set of modifier symbols, and is herein described as a modifier sticker. The said modifier sticker preferably has a security code or feature that prevents player tampering by utilizing a sticker from a separate ticket or printing a bogus sticker. It is also contemplated that a copy of the player symbol on the sticker may be printed on the card beneath the sticker to ensure that the sticker has not been altered. The opaque film concealing the modifier symbol on the sticker is scratched off, revealing the modifier. Each modifier symbol comprises a mathematical symbol (a plus sign, a minus sign, a multiplication sign, or a division sign) and a numeral. For example, the modifier symbol may depict a "+1" or a "−2". The modifier sticker is then placed in any sticker placement box, and modifies the winning number. For example, if a "+3" is placed next to a winning number "10", the modified winning number is the number "13". If a player number matches a modified winning number, a prize is awarded.

A fourth preferred embodiment of the present invention describes an instant lottery ticket and method of conducting a lottery instant scratch ticket game that comprises: a) providing a plurality of physical scratch tickets that are printed on a card; b) providing one array of game symbols on the card from a predetermined set of game symbols wherein the one array of game symbols comprises at least three game symbols within each of a predetermined amount of separate game grids; c) concealing the game symbols within each of the separate game grids with opaque removable film; d) providing at least one removable sticker on the ticket; e) providing at least one game symbol from a predetermined set of game symbols on each of the at least one removable sticker(s); f) concealing the at least one game symbol on each of the at least one removable sticker(s) with opaque removable film; g) providing at least one sticker placement box for each of the separate game grids; h) removing the opaque film to reveal the game symbols in each of the separate game grids; i) providing an explanation of a specific interaction between the revealed game symbols in each of the separate game grids; j) determining a prize if the said specific interaction between the said game symbols in each of the separate game grids is present; k) removing the opaque film concealing the game symbol on the at least one sticker to reveal the at least one game symbol; l) placing the at least one sticker revealing at least one game symbol in a sticker placement box; m) providing an explanation of a specific interaction between a revealed game symbol on the sticker and the game symbols in a game grid; n) determining a prize if the said specific interaction between the at least one revealed game symbol on the sticker and the game symbols in a game grid is present; and o) providing any prizes based on the specific interaction between the game symbols in each game grid and/or the specific interaction between the at least one revealed game symbol on the sticker and the game symbols in a game grid.

In an exemplary fourth preferred embodiment of the present invention, a lottery game is disclosed in which a plurality of instant scratch tickets is provided. A wager of cash, credits or non-monetary points may be required to play the game. The name of the game is shown on the ticket. Preferably, a printed verification code is provided and is concealed underneath an opaque film. The said verification code provides an encryption that guarantees that the ticket is valid and maintains the authenticity of the instant game ticket. The price of the ticket and instructions on how to play the game are provided.

One array of game symbols on the card from a first predetermined set of game symbols is provided wherein the one array of game symbols comprises three game symbols within each of a predetermined amount of separate game grids. For example, the first set of game symbols may be items that are associated with animals (dog bone, cat collar, fish bowl, bird house, etc.) The three game symbols within each of the separate game grids are concealed by an opaque removable film. One sticker placement box is provided for each of the separate game grids. The opaque film is scratched off to reveal the game symbols in each of the separate game grids. If the interaction between all three symbols provides a match, a prize is awarded.

At least one sticker is provided on the instant ticket and concealed by an opaque removable film. In this said fourth exemplary embodiment of the present invention, one sticker is provided, although it is contemplated that more than one sticker may be provided. The sticker comprises one category game symbol from a predetermined set of category game symbols. For instance, to continue the example above, the set of category game symbols may be animals (cat, dog, fish, bird, etc.). The sticker preferably has a security code or feature that prevents player tampering by utilizing a sticker from a separate ticket or printing a bogus sticker. It is also contemplated that a copy of the player symbol on the sticker may be printed on the card beneath the sticker to ensure that the sticker has not been altered. The opaque film concealing the game symbol on the sticker is scratched off, revealing the category symbol. The category sticker is then placed in a designated sticker placement box, although it is contemplated that the sticker may be placed in any sticker placement box. If all three game symbols in the game grid associated with the revealed and placed category sticker relate to the category (for example, dog bone-dog collar-dog bowl in a game grid with a dog sticker) an enhanced prize or instant prize is awarded.

A fifth preferred embodiment of the present invention describes an instant lottery ticket and method of conducting a lottery instant scratch ticket game that comprises: a) providing a plurality of physical scratch tickets that are printed on a card; b) providing one array of game symbols on the card from a first predetermined set of game symbols wherein the one array of game symbols comprises at least three game symbols within each of a predetermined amount of separate game grids; c) concealing the game symbols within each of the separate game grid with opaque removable film; d) providing at least one removable sticker on the ticket; e) providing a one game symbol from a second predetermined set of game symbols on each of the at least one removable sticker(s), wherein the second predetermined set of game symbols comprises multiplier symbols and wherein the sticker(s) is herein designated a multiplier sticker(s); f) concealing the at least one multiplier sticker(s) with opaque removable film; g) providing one sticker placement box for each of the separate game grids; h) removing the opaque film to reveal the game symbols in each of the separate game grids; i) providing an explanation of a specific interaction between the revealed game symbols in each of the separate game grids; j) determining a prize if the said specific interaction between the said game symbols in each of the separate game grids is present; k) providing the prize if the said specific interaction between the said game symbols in each of the separate game grids is present; l) removing the opaque film concealing the multiplier sticker; m) placing the at least one multiplier sticker in a sticker placement box; and n) multiplying any prizes by the multiplier on the multiplier ticket if the multiplier ticket is present in the sticker placement box associated with the prize. The specific interaction between the at least three game symbols in each of the separate game grids may be a match of at least three game symbols within each game grid. Alternately, the specific interaction between the at least three game symbols in each of the separate game grids may be a relationship of at least three game symbols within each game grid, wherein the relationship is determined by color, shape, icon theme, number or letter. The at least one multiplier sticker may be placed in a designated sticker placement box or alternately, in any sticker placement box.

Reference to the Figures will assist in further understanding of the practice of the present invention.

FIG. 1A illustrates the first preferred embodiment of the present invention, providing the elements of present invention that afford the specific gameplay thereof. A physical lottery instant game ticket 2 is provided, comprising a game ticket name 4, and a price 6. Eight game lines 8 are provided, each line providing two domino play symbols 10. Eight play spaces (YOUR DOMINOS) 12 are located between the two play symbols in each line, and covered with an opaque removable film. A player domino sticker (YOUR DOMINO STICKER) 14 is provided and covered with an opaque removable film. An explanation of the sticker 16 is provided. An opaque removable film conceals a multiplier symbol (DICE MULTIPLIER) 18. A paytable 20 is shown, providing pays for achieving winning lines. "How to Play" instructions 22 are also shown.

Figure 1B:
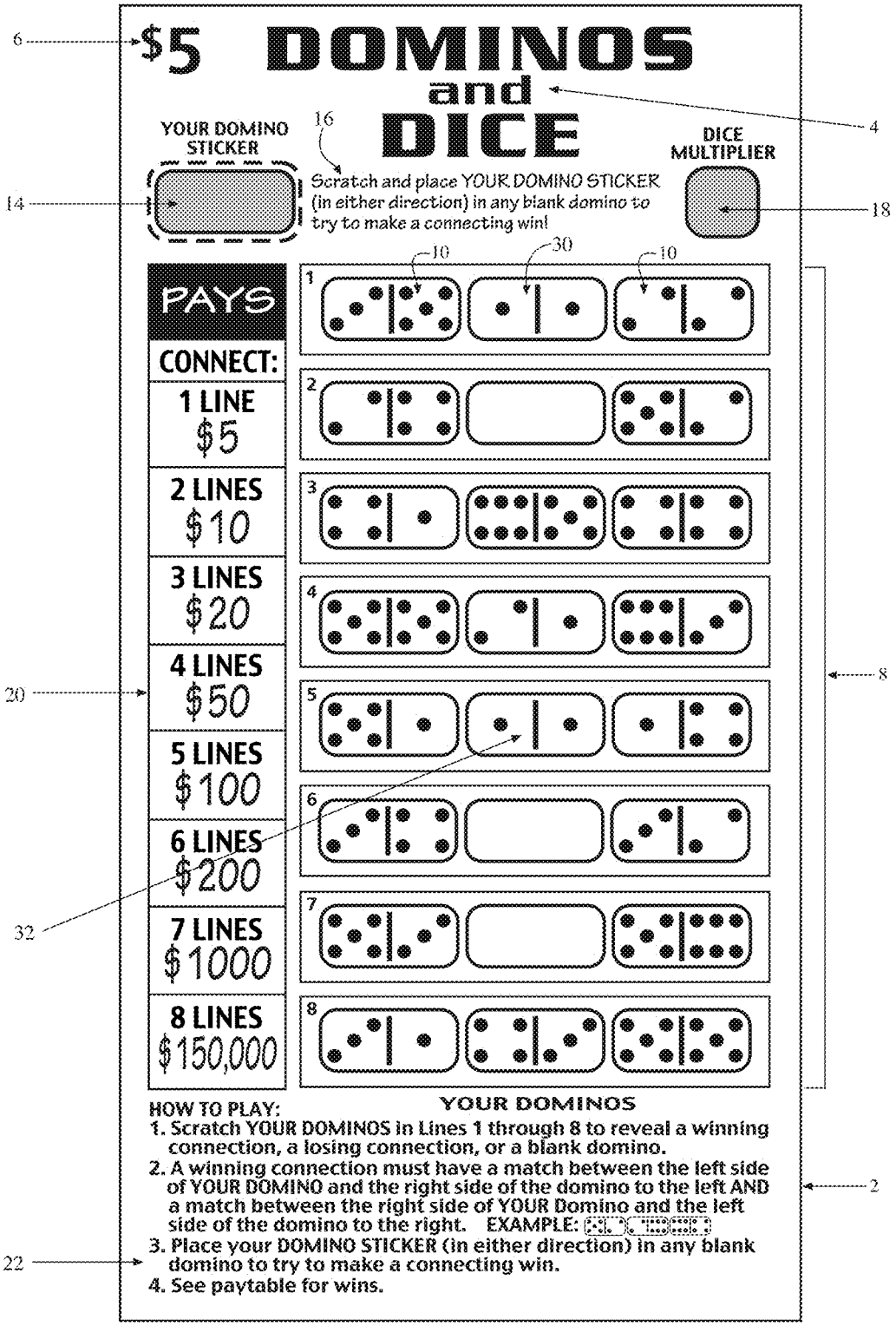
FIG. 1B refers to FIG. 1A and shows the ticket at a later stage.

FIG. 1B shows the elements of FIG. 1A wherein the player, according to the gameplay instructions 22, has removed or "scratched off" the opaque film concealing the play spaces to reveal either a player symbol domino or a blank player space 30 in each game line. According to the instructions, a winning line must have a match between the left side of the player symbol domino and the right side of the left-hand play symbol domino, AND a match between the right side of the player symbol domino and the left side of the right-hand play symbol domino. Here in line 5 the player has achieved a winning result 32.

Figure 1C:
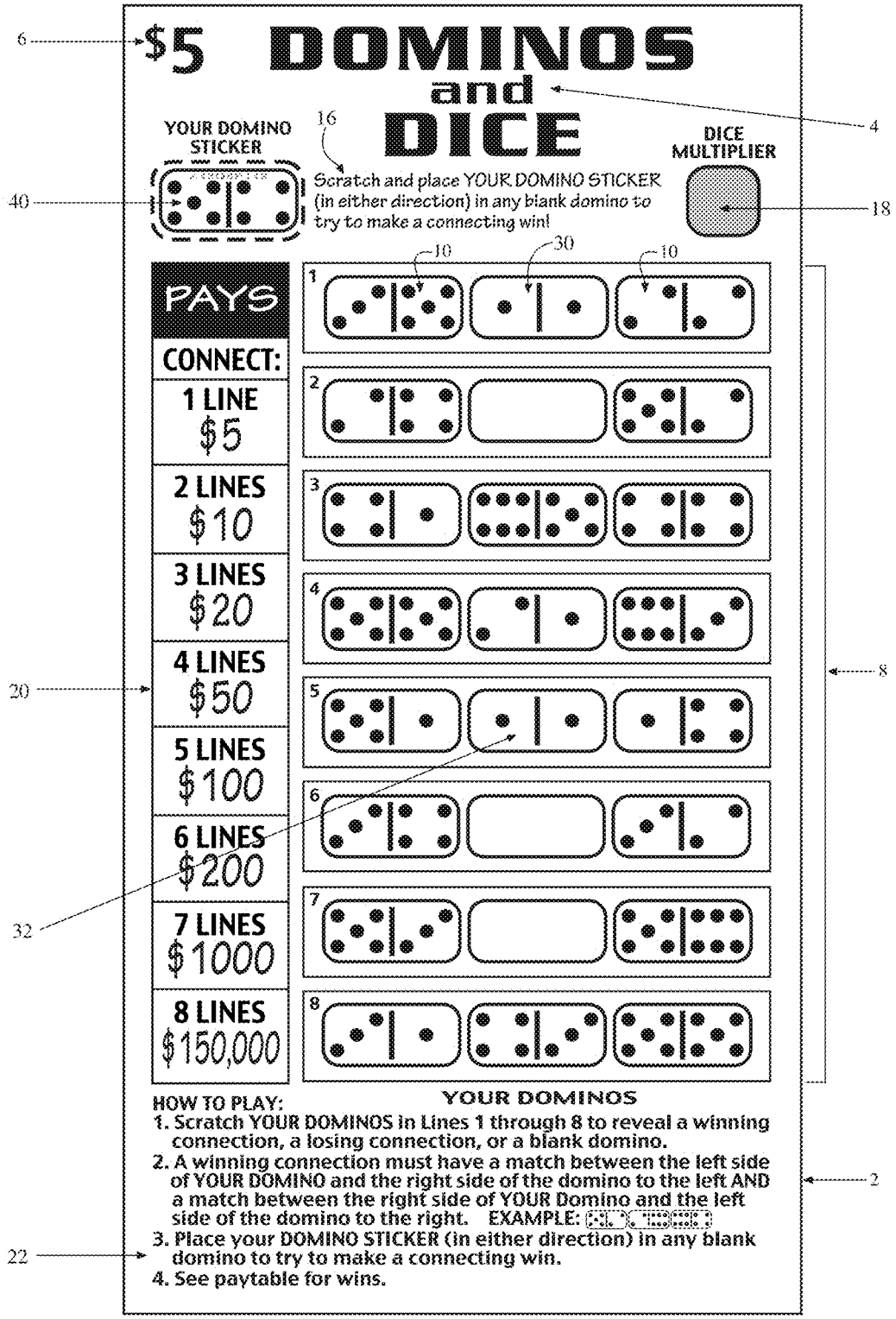
FIG. 1C refers to FIG. 1B and shows the ticket at a later stage.

FIG. 1C shows the elements of FIG. 1B wherein the player, according to the gameplay instructions 22, has removed or "scratched off" the opaque film concealing the player domino sticker to reveal the player domino sticker 40. The player domino sticker has a special code printed thereon that is associated with a unique ticket number (not shown) in order to prevent fraudulent stickers from being utilized.

Figure 1D:
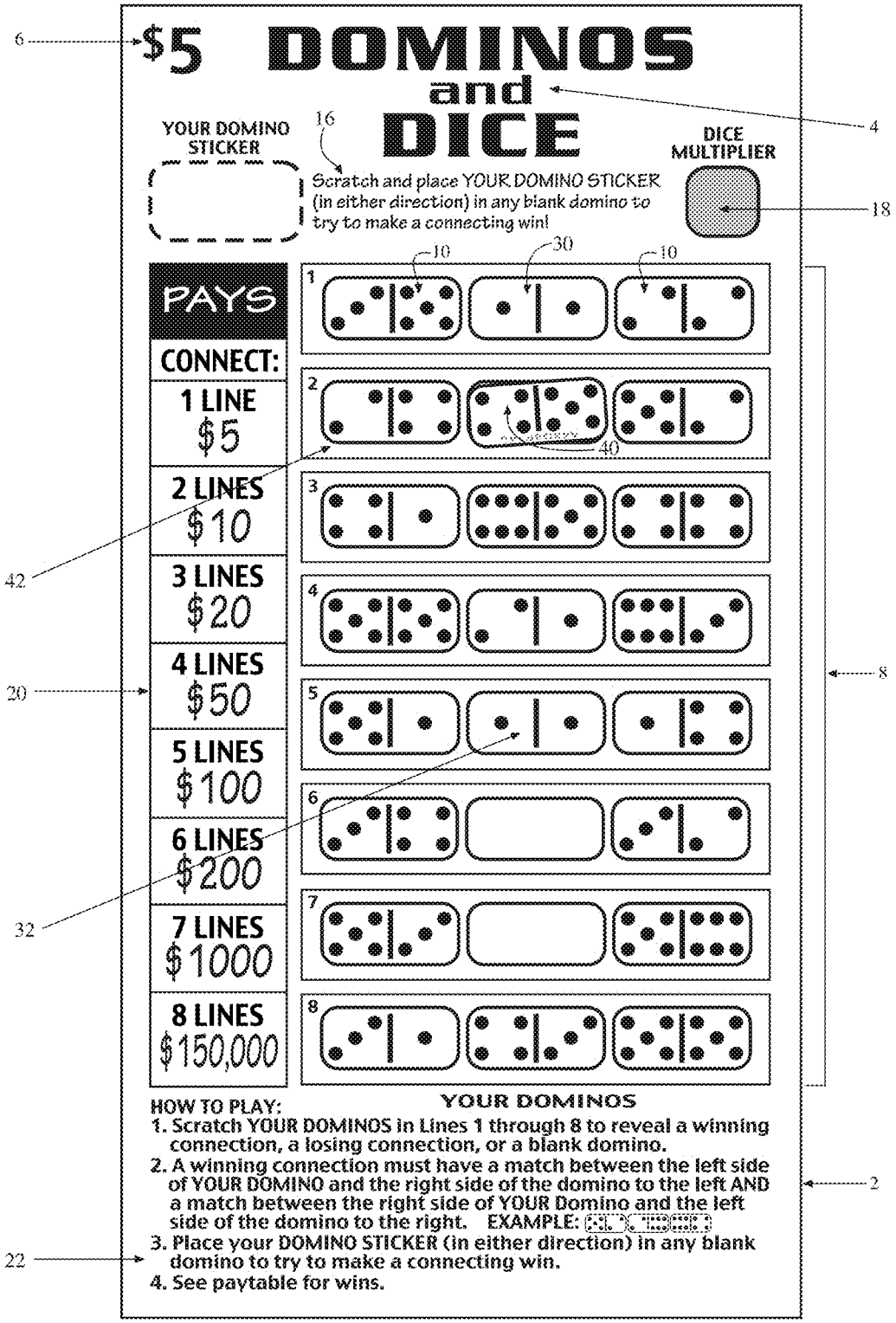
FIG. 1D refers to FIG. 1C and shows the ticket at a later stage.

FIG. 1D shows the elements of FIG. 1C wherein the player, according to the gameplay instructions 22, has placed the player domino sticker 40 in line 2 in order to make a winning line 42. It should be noted that the sticker may preferably be placed in only one player space, and the sticker may not necessarily produce a winning line.

Figure 1E:
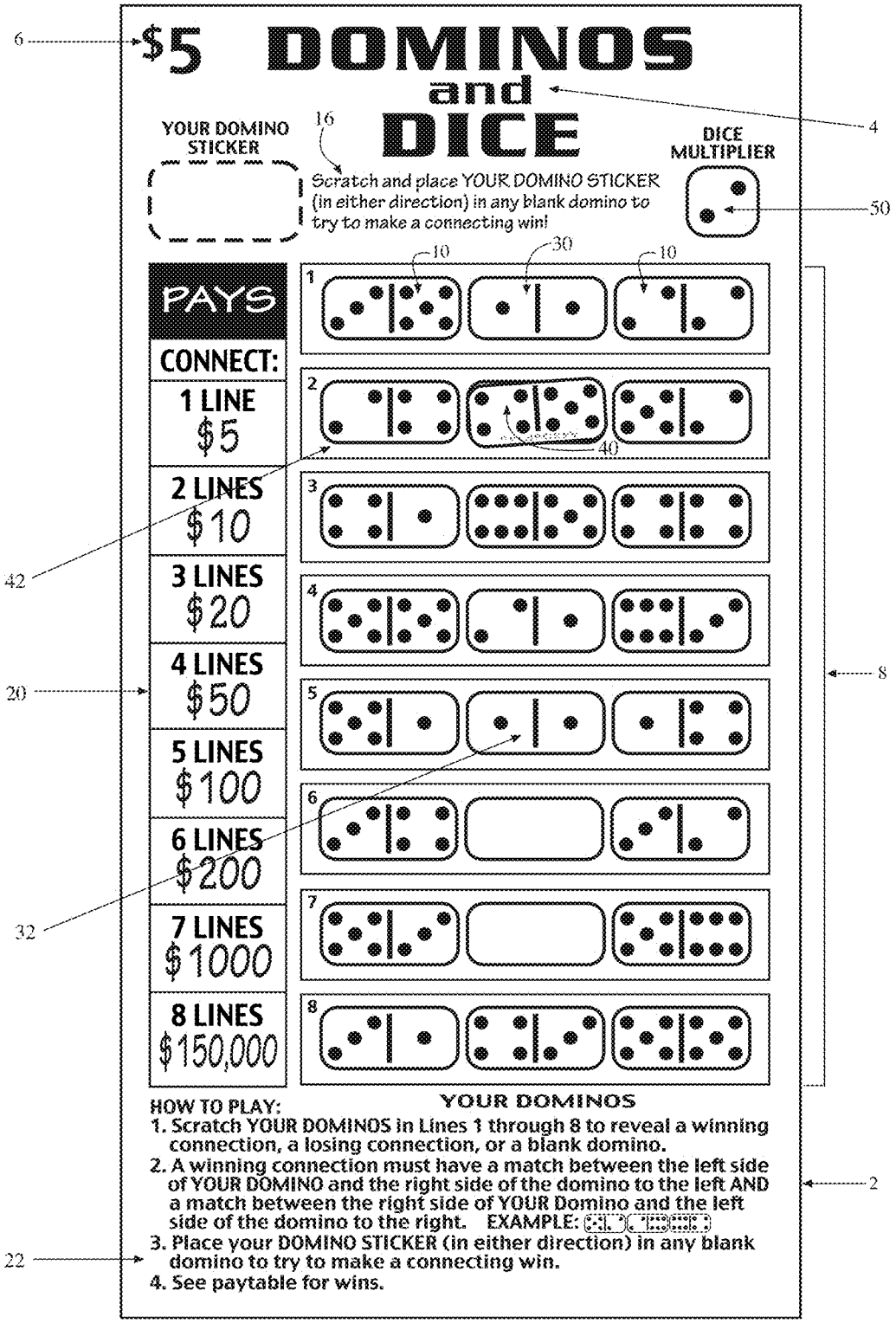
FIG. 1E refers to FIG. 1D and shows the ticket at a final stage.

FIG. 1E shows the elements of FIG. 1D wherein the player has removed or "scratched off" the opaque film concealing the DICE MULTIPLIER to reveal a die with two "pips" 50, providing a 2× multiplier. In this example, the player has achieved two winning lines (line 5 and line 2) for a win of $10 according to the paytable 20. The win is multiplied by 2, for a total final win of $20.

Figure 2A:
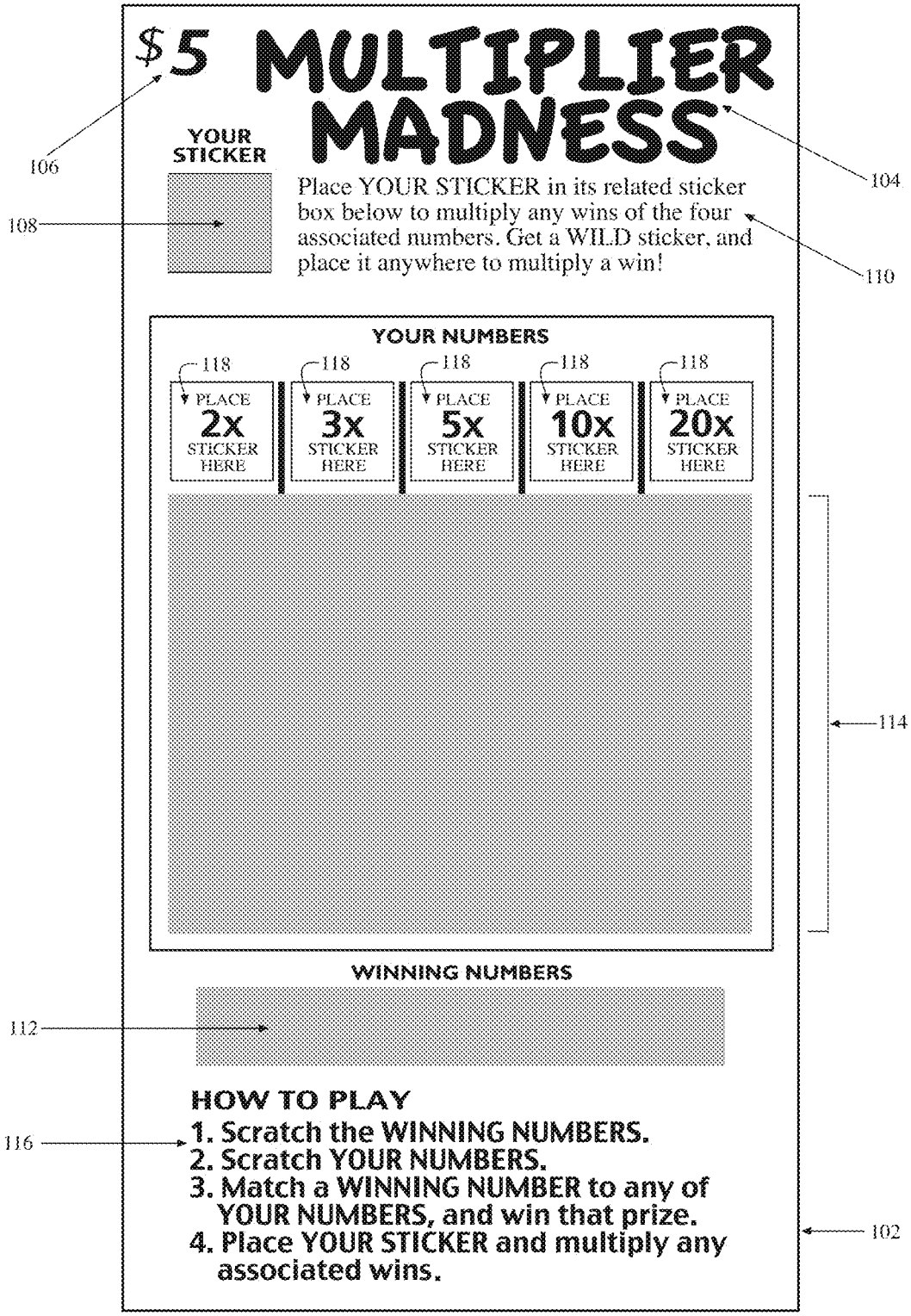
FIG. 2A shows an initial instant scratch ticket containing the game elements for a game utilizing the game technology described in a second preferred embodiment of the present invention herein.

FIG. 2A illustrates the second preferred embodiment of the present invention, providing the elements of present invention that afford the specific gameplay thereof. A physical lottery instant game ticket 102 is provided, comprising a game ticket name 104 and a price 106. A player sticker (YOUR STICKER) 108 is provided and covered with an opaque removable film. An explanation of the sticker 110 is provided. Winning game symbols (WINNING NUMBERS) are concealed by an opaque removable film 112 and player symbols (YOUR NUMBERS) are concealed by an opaque removable film 114. "How to Play" gameplay instructions 116 are shown, as well as five sticker placement boxes 118, labeled 2×, 3×, 5×, 10× and 20×.

Figure 2B:
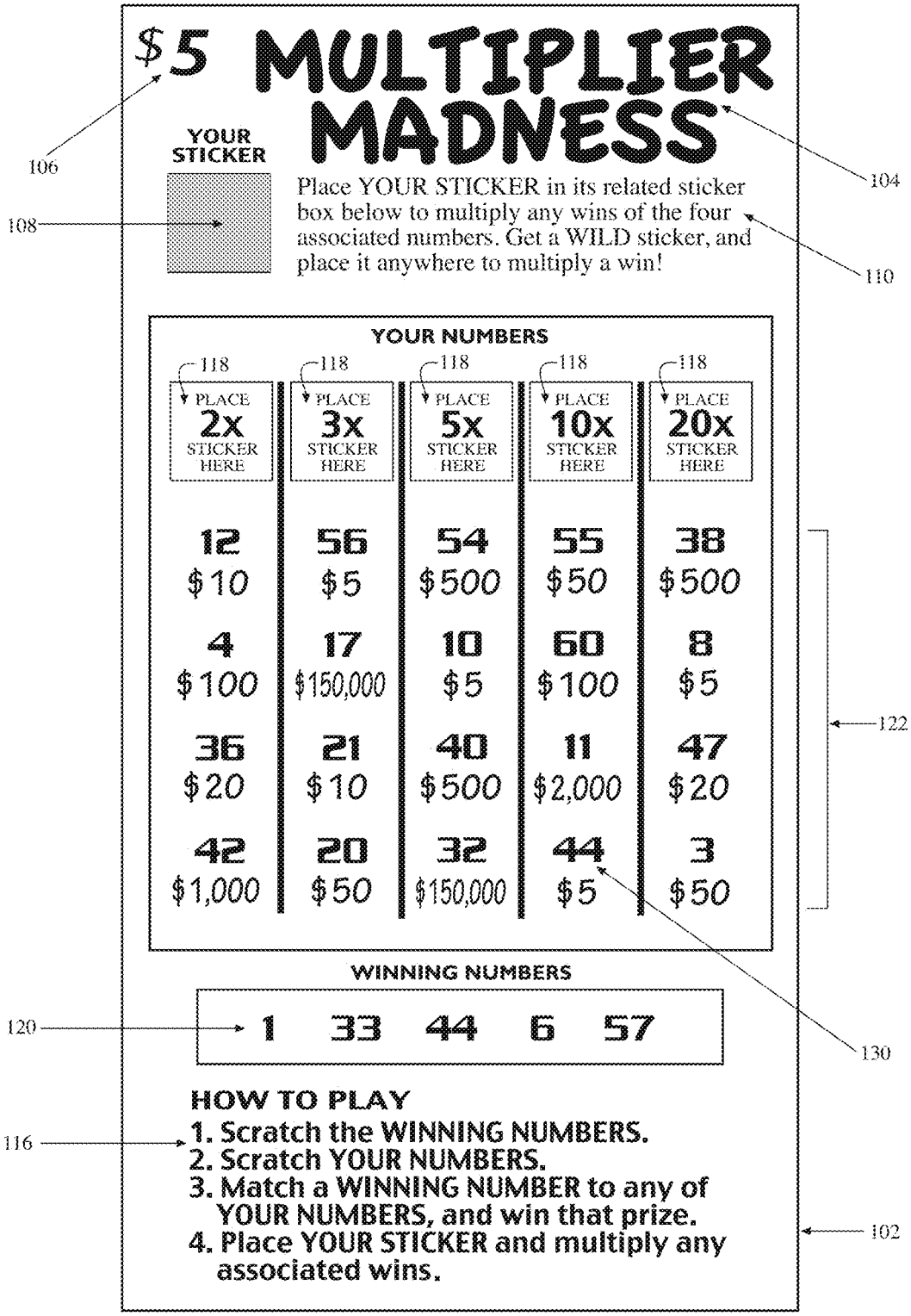
FIG. 2B refers to FIG. 2A and shows the ticket at a later stage.

FIG. 2B shows the elements of FIG. 2A wherein the player, according to the gameplay instructions 116, has removed or "scratched off" the opaque film to reveal five winning numbers 120 and twenty player numbers 122. Four player numbers and their related prizes are associated with each of the five sticker placement boxes. Here the player has matched the winning number "44" 130 that is associated with the 10× sticker placement box for a win of $5.

Figure 2C:
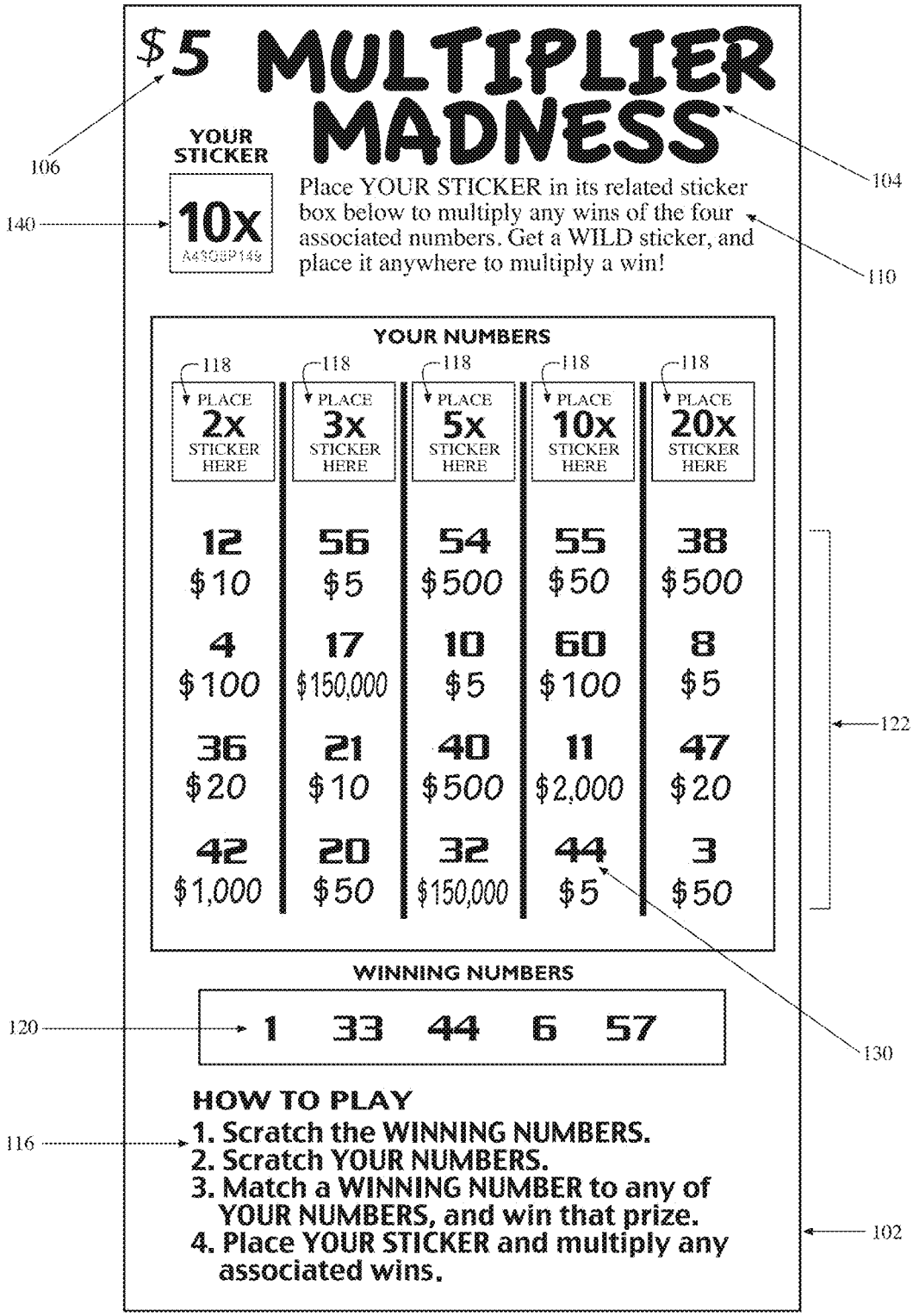
FIG. 2C refers to FIG. 2B and shows the ticket at a later stage.

FIG. 2C shows the elements of FIG. 2B wherein the player has removed or "scratched off" the opaque film to reveal a 10× multiplier sticker (with safety code) 140.

Figure 2D:
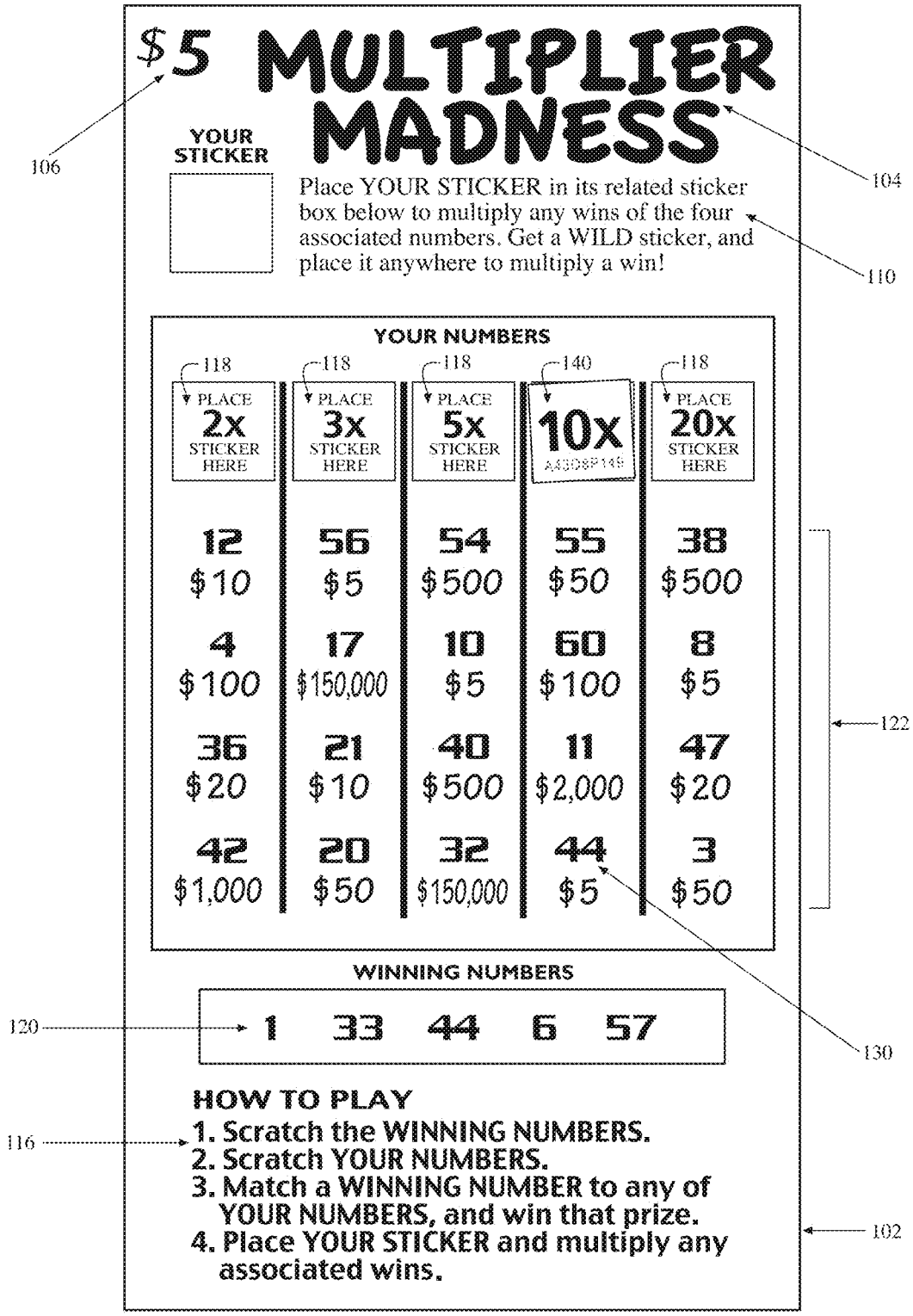
FIG. 2D refers to FIG. 2C and shows the ticket at a final stage.

FIG. 2D shows the elements of FIG. 2C wherein the player has placed the 10× multiplier sticker 140 in the sticker placement box 118 that comprises the 10× designation. (The multiplier on the sticker must match the multiplier in the sticker placement box.) The initial win of $5 is now multiplied by 10, for a total final win of $50. It should be noted that a WILD multiplier symbol (not shown) may be printed on the sticker instead of a specific multiplier. In this said case, the WILD multiplier may be placed in ANY sticker placement box, and any win would be multiplied by the multiplier designation of that same said sticker placement box.

Figure 3A:
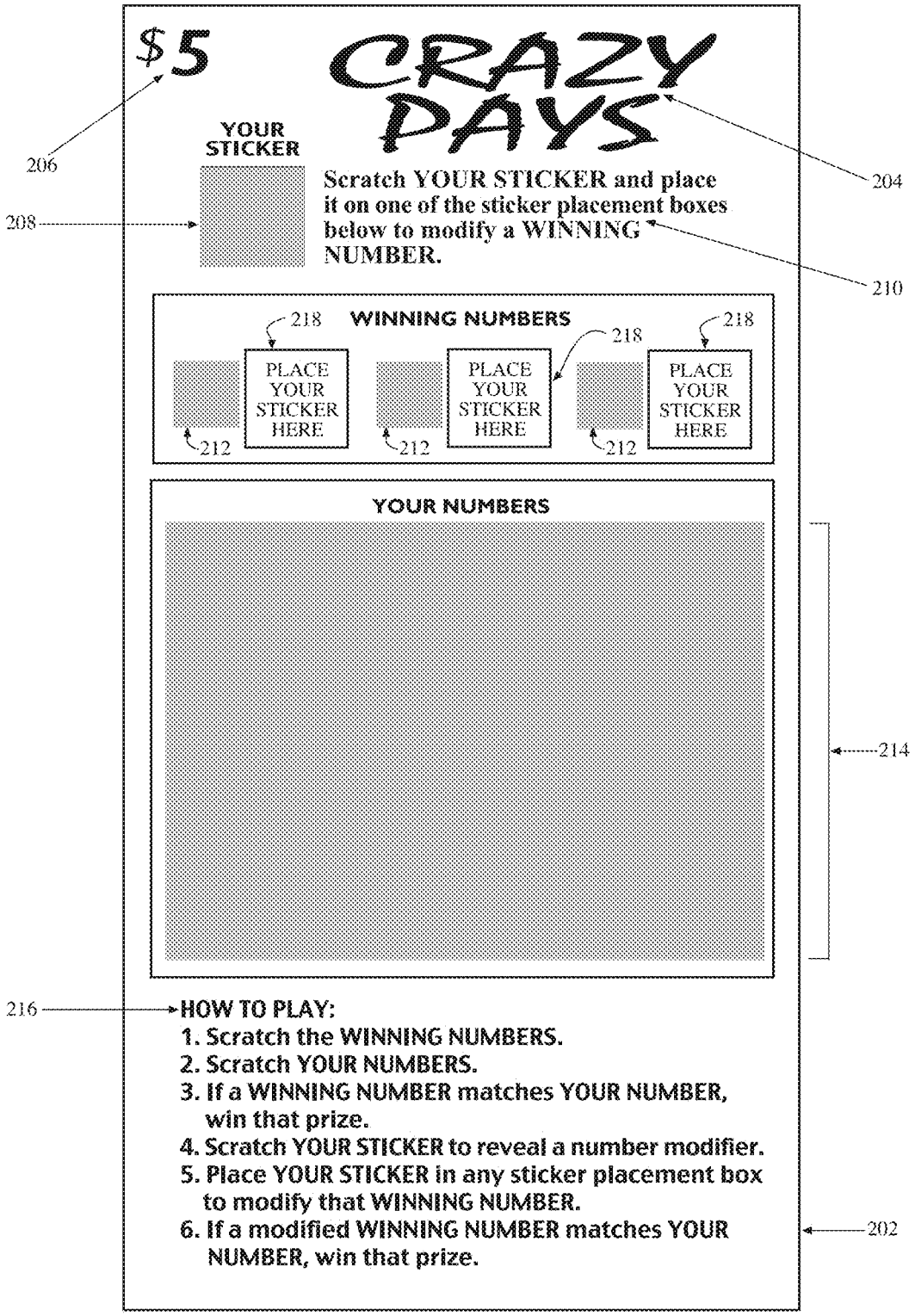
FIG. 3A shows an initial instant scratch ticket containing the game elements for a game utilizing the game technology described in a third preferred embodiment of the present invention herein.

FIG. 3A illustrates the third preferred embodiment of the present invention, providing the elements of present invention that afford the specific gameplay thereof. A physical lottery instant game ticket 202 is provided, comprising a game ticket name 204 and a price 206. A player sticker (YOUR STICKER) 208 is provided and covered with an opaque removable film. An explanation of the sticker 210 is provided. Winning game symbols (WINNING NUMBERS) are concealed by an opaque removable film 212 and player symbols (YOUR NUMBERS) are concealed by an opaque removable film 214. "How to Play" gameplay instructions 216 are shown, as well as three sticker placement boxes 218 associated with the three winning game numbers.

Figure 3B:
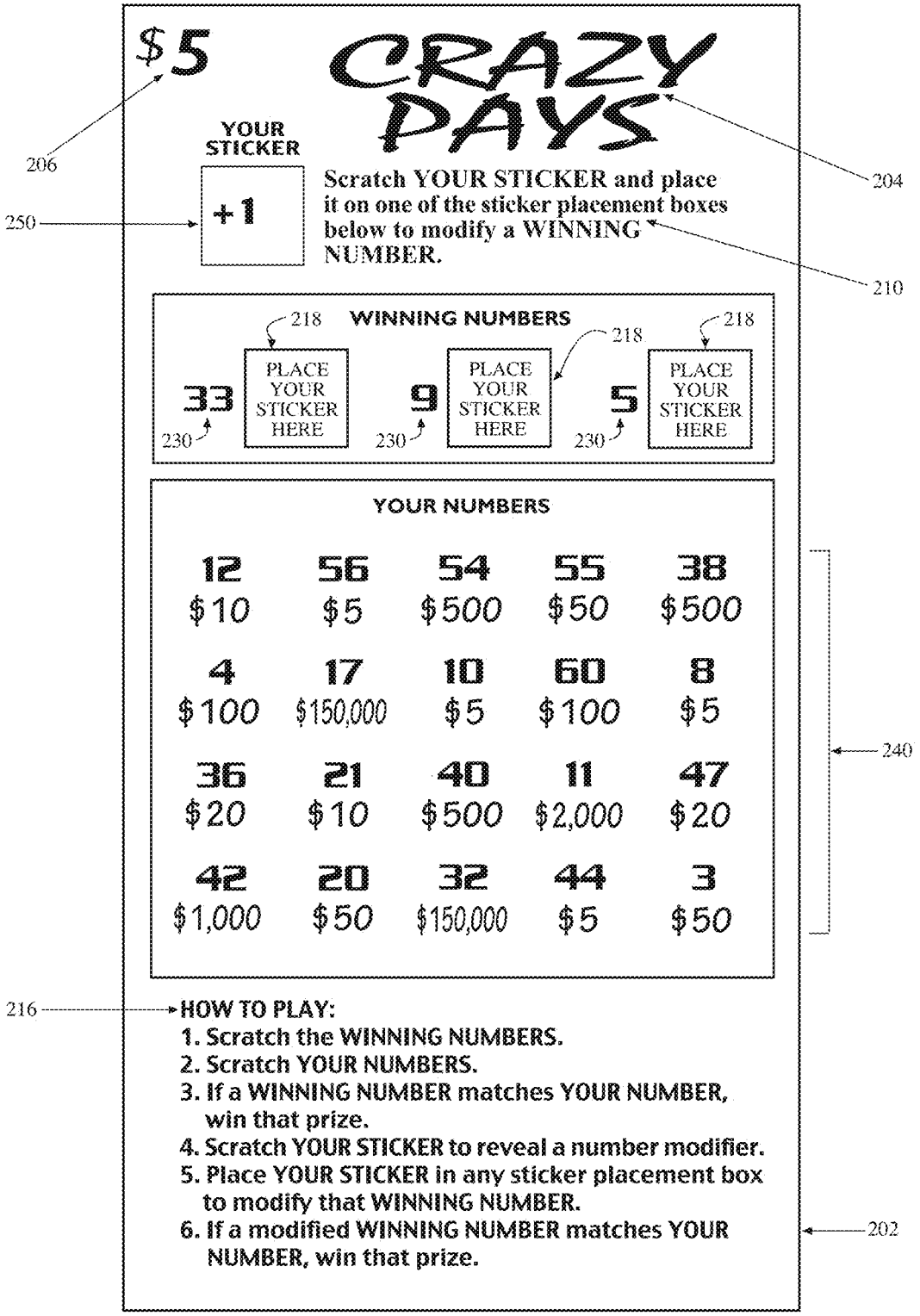
FIG. 3B refers to FIG. 3A and shows the ticket at a later stage.

FIG. 3B shows the elements of FIG. 3A wherein the player, according to the gameplay instructions 216, has removed or "scratched off" the opaque film to reveal three winning numbers 230 and twenty player numbers 240. The player has removed or "scratched off" the opaque film to reveal a modifier sticker 250 with a "+1" designation. Here there are no matches between the winning game numbers and the player numbers.

Figure 3C:
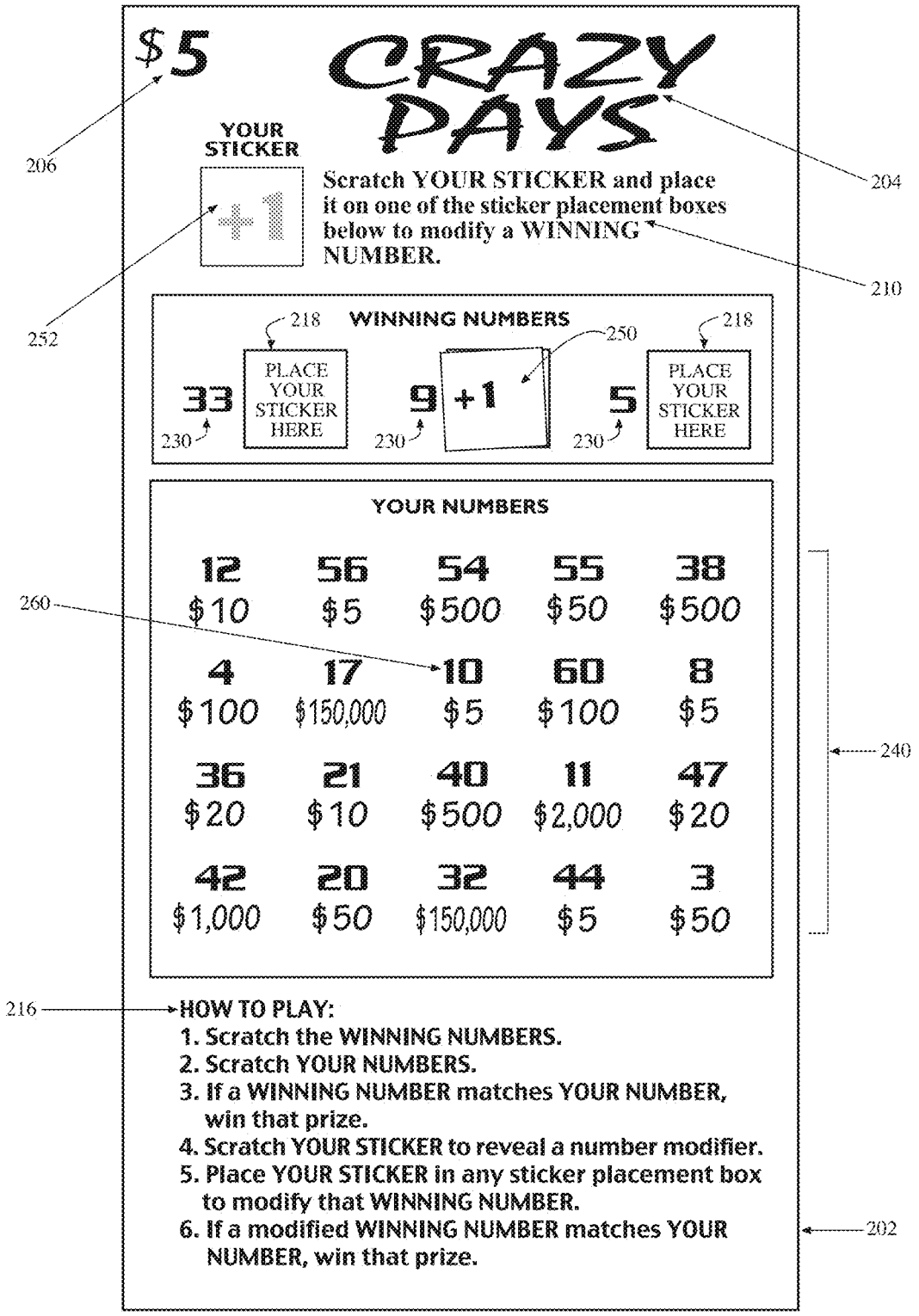
FIG. 3C refers to FIG. 3B and shows the ticket at a final stage.

FIG. 3C shows the elements of FIG. 3B wherein the player has placed the "+1" modifier sticker 250 in the sticker placement box 118 that is associated with the winning game number "9". The YOUR STICKER box reveals a "+1" designation 252 printed on the card in order to provide a security feature, i.e., the designation on the sticker must match the designation on the card. The winning game number "9" is now increased by "1", for a final winning game number "10". The final winning game number "10" now matches the player number "10" 260, for a win of $5.

Figure 4A:
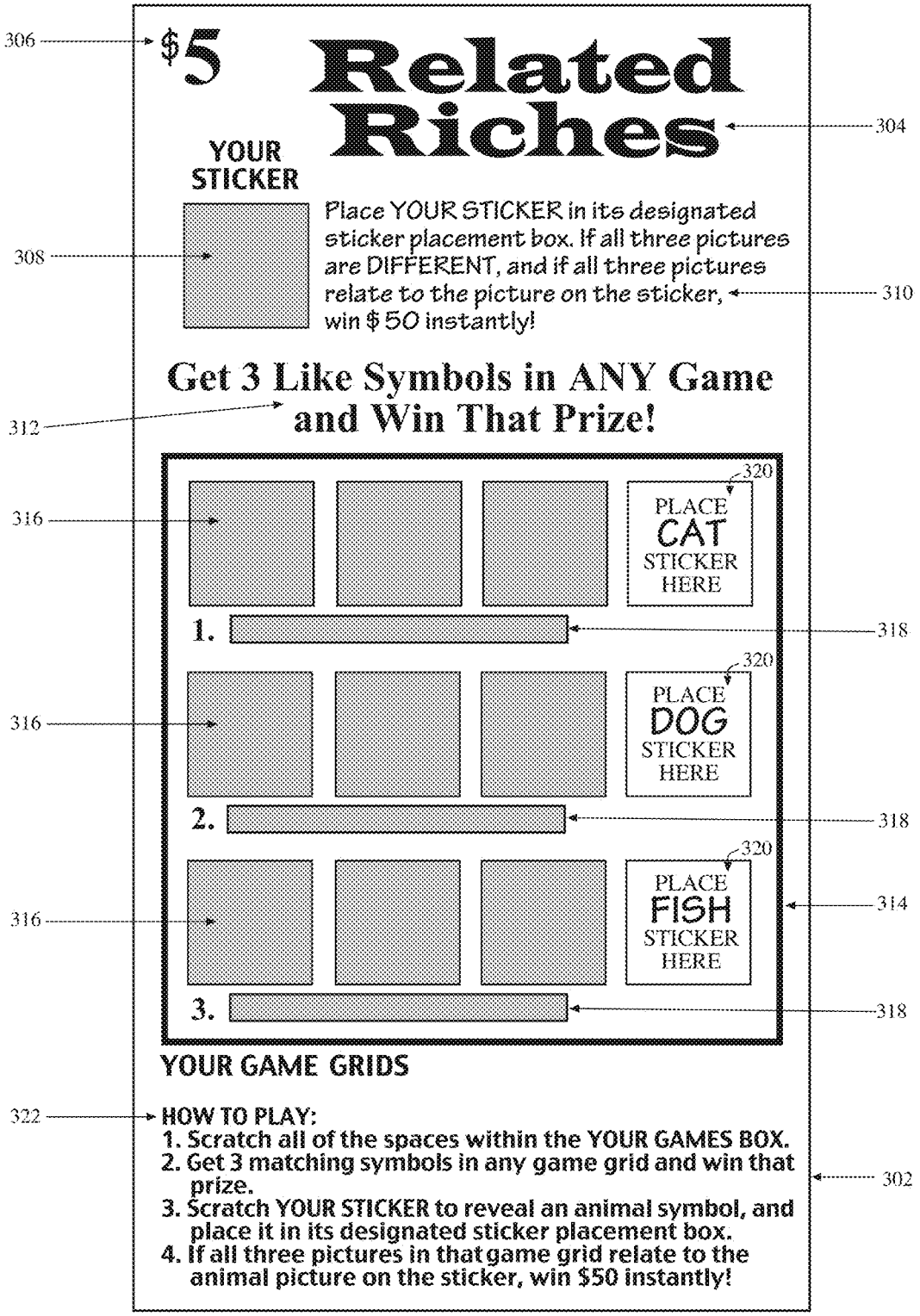
FIG. 4A shows an initial instant scratch ticket containing the game elements for a game utilizing the game technology described in a fourth preferred embodiment of the present invention herein.

FIG. 4A illustrates the fourth preferred embodiment of the present invention, providing the elements of present invention that afford the specific gameplay thereof. A physical lottery instant game ticket 302 is provided, comprising a game ticket name 304 and a price 306. A player sticker (YOUR STICKER) 308 is provided and covered with an opaque removable film. An explanation of the sticker 310 is provided. An explanation of the basic winning rules is shown 312. A box (YOUR GAME GRIDS) 314 contains three game grids labeled 1. 2. and 3., each comprising three symbol boxes concealed by an opaque removable film 316 and a prize key box 318 concealed by an opaque removable film that provides wins for achieving three like symbols in any one game grid. A specific ticket placement box 320 is associated with each game grid, whereby each ticket placement box designates a specific animal (cat, dog, fish). "How to Play" gameplay instructions 322 are shown.

Figure 4B:
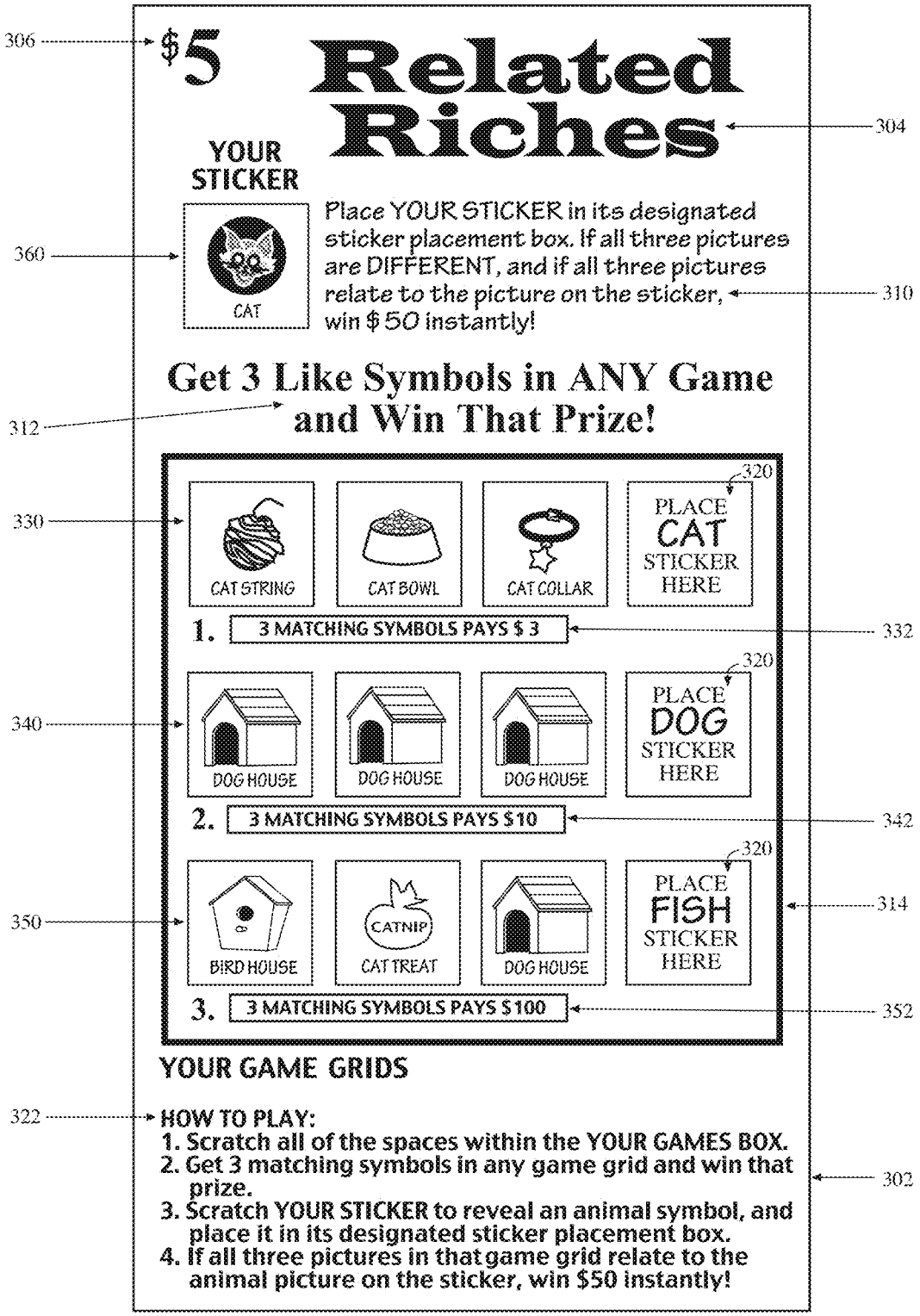
FIG. 4B refers to FIG. 4A and shows the ticket at a later stage.

FIG. 4B shows the elements of FIG. 4A wherein the player, according to the gameplay instructions 322, has removed or "scratched off" the opaque film to reveal three symbols in game grid 1 330 and the prize key 332, three symbols in game grid 2 340 and the prize key 342, and three symbols in game grid 3 350 and the prize key 352. Game grid 2 is a win of $10 for three like doghouse symbols. The player has removed or "scratched off" the opaque film to reveal the category symbol on "YOUR STICKER 360 with a "CAT" designation.

Figure 4C:
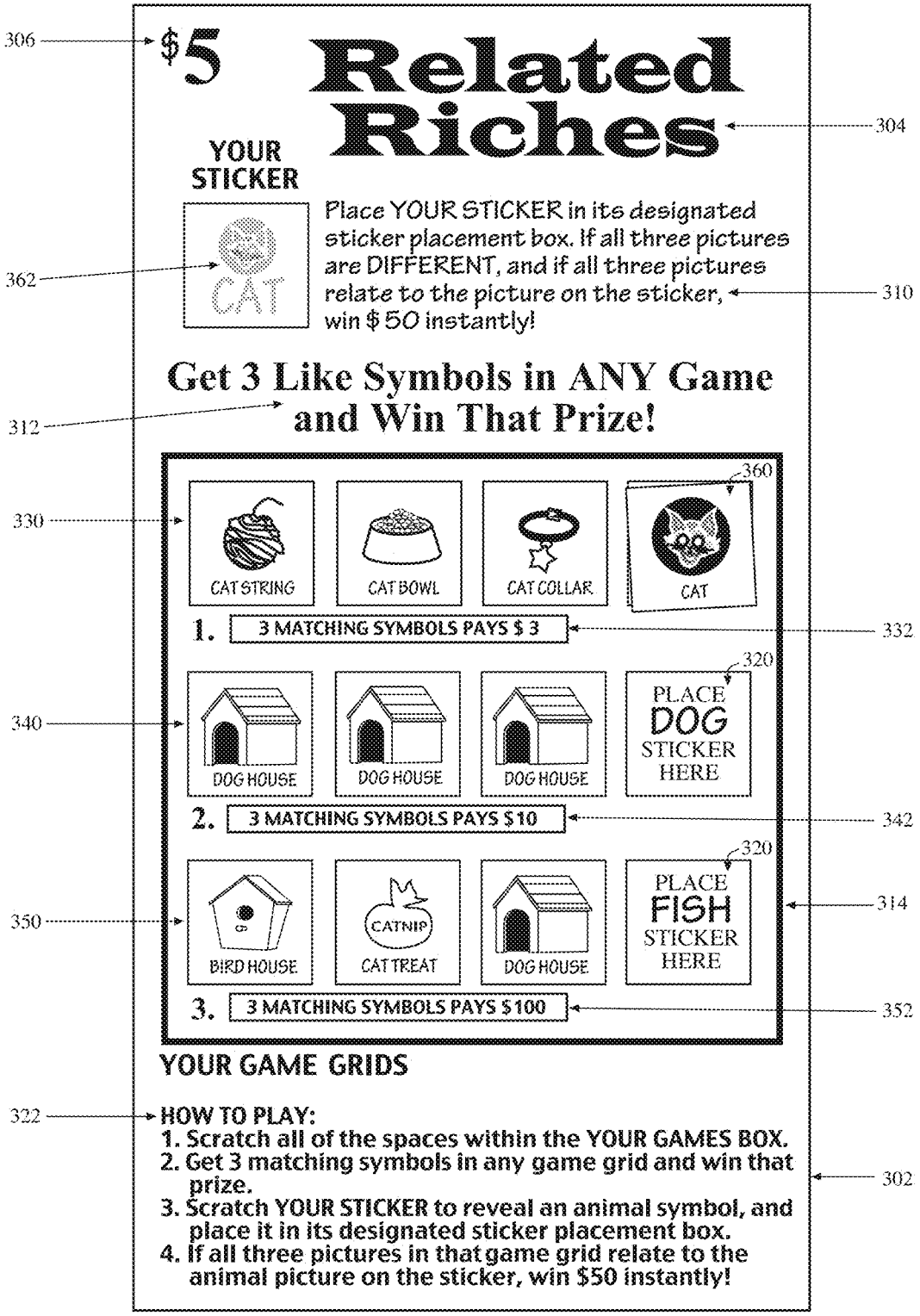
FIG. 4C refers to FIG. 4B and shows the ticket at a final stage.

FIG. 4C shows the elements of FIG. 4B wherein the player has placed the "CAT" sticker 360 in its associated sticker placement box. The YOUR STICKER box reveals a "CAT" designation 362 that is printed on the card in grey in order to provide a security feature, i.e., the designation on the sticker must match the designation on the card. Since game grid 1 has three different cat symbols 330 relating to the "CAT" sticker, the player receives an instant win of $50. The total win for the ticket is $60.

Although specific examples and specific win tables have been provided in this discussion, these specifics are intended to be only support for the generic concepts of the invention and are not intended to be absolute limits in the scope of the technology discussed.

What is claimed:

1. A method of conducting a lottery instant scratch ticket game comprises:

a) providing a plurality of physical scratch tickets that are printed on a card;

b) providing an array of game symbols on the ticket card from a predetermined set of game symbols as play symbols;

c) providing an array of game symbols on the ticket card from the predetermined set of game symbols as player symbols, wherein the player symbols may be provided within blank player spaces and wherein predetermined player symbols interact with predetermined play symbols;

d) concealing the player spaces with an opaque removable film;

e) providing at least one removable sticker on the ticket;

f) providing at least one player symbol on the at least one removable sticker;

g) concealing the at least one removable sticker with an opaque removable film;

h) removing the opaque removable film concealing the player spaces to reveal either a player symbol or a blank player space;

i) providing an explanation of a specific interaction between a revealed player symbol on the card and the play symbols;

j) determining a prize if the said specific interaction between a revealed player symbol on the card and a play symbol is present;

k) removing the opaque removable film concealing the at least one sticker to reveal the player symbol(s);

l) placing the at least one sticker revealing a player symbol in any one revealed blank player space(s);

m) providing an explanation of a specific interaction between a revealed player symbol on the sticker and the play symbols;

n) determining a prize if the said specific interaction between a revealed player symbol on the sticker and a play symbol is present; and o) providing any prizes based on the specific interaction between a player symbol on the card and the play symbols and/or the specific interaction between a player symbol on the sticker and the play symbols.

2. The method of claim 1 wherein the set of game symbols comprises dominos wherein each domino comprises a left side providing 1 through 6 "pips" and a right side providing 1 through 6 "pips".

3. The method of claim 2 wherein an array of play symbols comprises two dominos that are provided horizontally in each of a predetermined amount of separate game areas.

4. The method of claim 3 wherein an array of player spaces is provided so that there is one player space disposed horizontally between the two domino play symbols in each game area.

5. The method of claim 4 wherein removing the opaque removable film concealing the player spaces reveals either a domino as a player symbol or a blank player space.

6. The method of claim 5 wherein the interaction between the player symbol domino and the adjoining play symbol dominos in each game area comprises comparing the left side of the player symbol domino with the right side of the left-hand play symbol domino, and the right side of the player symbol domino with the left side of the right-hand play symbol domino.

7. The method of claim 6 wherein if both sides of the player symbol domino match the adjoining play symbol dominos, a prize is awarded.

8. The method of claim 6 wherein if both sides of the player symbol domino do not match the adjoining play symbol dominos, a prize is not awarded.

9. The method of claim 5 wherein if at least one blank player space is provided, the revealed sticker comprising a player symbol domino may be placed in one blank player space.

10. The method of claim 9 wherein the player symbol domino sticker may be placed either in a 0° angle disposition or rotated 180° angle disposition.

11. The method of claim 9 wherein if both sides of the player symbol domino sticker match the adjoining play symbol dominos, a prize is awarded.

12. The method of claim 1 wherein a dice symbol is provided as a multiplier of 1x, 2x, 3x, 4x, 5x or 6x any prizes.

13. A method of conducting a lottery instant scratch ticket game comprises:

a) providing a plurality of physical scratch tickets that are printed on a card;
b) providing an array of winning game symbols on the ticket card from a predetermined set of game symbols;
c) providing an array of player symbols on the ticket card from the predetermined set of game symbols;
d) concealing the winning game symbols with an opaque removable film;
e) concealing the player symbols with an opaque removable film;
f) providing at least one removable sticker on the ticket;
g) providing a multiplier symbol from a predetermined set of multiplier symbols on the at least one removable sticker as a multiplier sticker;
h) concealing the at least one multiplier sticker with an opaque removable film;
i) removing the opaque removable film concealing the winning game symbols to reveal the winning game symbols;
j) removing the opaque removable film concealing the player symbols to reveal the player symbols;
k) determining a prize if a winning game symbol matches a player symbol;
l) providing at least one sticker placement box;
m) providing a predetermined amount of player symbols associated with each sticker placement box so that each sticker placement box is associated with a like amount of player symbols;
n) removing the opaque removable film concealing the at least one multiplier sticker to reveal the multiplier symbol(s);
o) placing the at least one sticker revealing a multiplier symbol in a sticker placement box;
p) determining an enhanced prize if the placed sticker is associated with a winning player symbol; and
q) providing any prizes based on the winning player symbol(s) and the multiplier sticker(s).

14. The method of claim 13 wherein each sticker placement box comprises a designated different multiplier from the predetermined set of multipliers.

15. The method of claim 14 wherein the at least one sticker revealing a multiplier symbol is placed in its designated sticker placement box.

16. A method of conducting a lottery instant scratch ticket game comprises:

a) providing a plurality of physical scratch tickets that are printed on a card;
b) providing an array of winning game numbers on the ticket card from a predetermined set of numerical game symbols;
c) providing an array of player numbers on the ticket card from the predetermined set of numerical game symbols;
d) concealing the winning game numbers with an opaque removable film;
e) concealing the player numbers with an opaque removable film;
f) providing at least one removable sticker on the ticket as a player sticker;
g) providing a modifying numerical symbol from a predetermined set of modifying numerical symbols on the player sticker;
h) concealing the at least one player sticker with an opaque removable film;
i) removing the opaque removable film concealing the winning game numbers to reveal the winning game numbers;
j) removing the opaque removable film concealing the player numbers to reveal the player numbers;
k) determining a prize if a winning game number matches a player number;
l) providing one sticker placement box for each of the winning game numbers wherein the winning game number is modified by the player sticker;
m) removing the opaque removable film concealing the at least one player sticker to reveal the modifying numerical symbol;
n) placing the at least one player sticker in any sticker placement box wherein the winning game number is modified by the player sticker;
o) determining a prize if the modified winning game number matches a player number; and
p) providing any prizes based on the winning player number(s) and the player numbers and/or a modified winning game number and a player number.

17. The method of claim 16 wherein each modifying numerical symbol comprises one mathematical symbol (a plus sign, a minus sign, a multiply sign or a division sign) and one numeral.

18. A method of conducting a lottery instant scratch ticket game comprises:

a) providing a plurality of physical scratch tickets that are printed on a card;
b) providing one array of game symbols on the card from a predetermined set of game symbols wherein the one array of game symbols comprises at least three game symbols within each of a predetermined amount of separate game grids;
c) concealing the game symbols within each of the separate game grids with opaque removable film;
d) providing at least one removable sticker on the ticket;
e) providing at least one game symbol from a predetermined set of game symbols on each of the at least one removable sticker(s);
f) concealing the at least one game symbol on each of the at least one removable sticker(s) with opaque removable film;
g) providing at least one sticker placement box for each of the separate game grids;
h) removing the opaque film to reveal the game symbols in each of the separate game grids;
i) providing an explanation of a specific interaction between the revealed game symbols in each of the separate game grids;
j) determining a prize if the said specific interaction between the said game symbols in each of the separate game grids is present;
k) removing the opaque film concealing the game symbol on the at least one sticker to reveal the at least one game symbol;
l) placing the at least one sticker revealing at least one game symbol in a sticker placement box;
m) providing an explanation of a specific interaction between a revealed game symbol on the sticker and the game symbols in a game grid;
n) determining a prize if the said specific interaction between the at least one revealed game symbol on the sticker and the game symbols in a game grid is present; and o) providing any prizes based on the specific interaction between the game symbols in each game grid and/or the specific interaction between the at least one revealed game symbol on the sticker and the game symbols in a game grid.

19. The method of claim 18 wherein the specific interaction between the at least three game symbols in each of the separate game grids is a match of at least three game symbols within each game grid.

20. The method of claim 18 wherein the specific interaction between the at least three game symbols in each of the separate game lines is a relationship of at least three game symbols within each game grid, wherein the relationship is determined by color, shape, icon theme, number or letter.

21. The method of claim 18 wherein the at least one sticker revealing at least one game symbol is placed in a designated sticker placement box.

22. The method of claim 18 wherein the at least one sticker revealing at least one game symbol is placed in any sticker placement box.

23. The method of claim 18 wherein the specific interaction between a revealed at least one game symbol on the sticker and the game symbols in a game grid is a match between said revealed at least one game symbol on the sticker and the said game symbols in a game grid.

24. The method of claim 18 wherein the specific interaction between a revealed at least one game symbol on the sticker and the game symbols in a game grid is a relationship of at least three game symbols within each game grid, wherein the relationship is determined by color, shape, icon theme, number or letter.

25. A method of conducting a lottery instant scratch ticket game comprises:

a) providing a plurality of physical scratch tickets that are printed on a card;

b) providing one array of game symbols on the card from a first predetermined set of game symbols wherein the one array of game symbols comprises at least three game symbols within each of a predetermined amount of separate game grids;

c) concealing the game symbols within each of the separate game grid with opaque removable film;

d) providing at least one removable sticker on the ticket;

e) providing a one game symbol from a second predetermined set of game symbols on each of the at least one removable sticker(s), wherein the second predetermined set of game symbols comprises multiplier symbols and wherein the sticker(s) is herein designated a multiplier sticker(s);

f) concealing the at least one multiplier sticker(s) with opaque removable film;

g) providing one sticker placement box for each of the separate game grids;

h) removing the opaque film to reveal the game symbols in each of the separate game grids;

i) providing an explanation of a specific interaction between the revealed game symbols in each of the separate game grids;

j) determining a prize if the said specific interaction between the said game symbols in each of the separate game grids is present;

k) providing the prize if the said specific interaction between the said game symbols in each of the separate game grids is present;

l) removing the opaque film concealing the multiplier sticker;

m) placing the at least one multiplier sticker in a sticker placement box; and n) multiplying any prizes by the multiplier on the multiplier ticket if the multiplier ticket is present in the sticker placement box associated with the prize.

26. The method of claim 25 wherein the specific interaction between the at least three game symbols in each of the separate game grids is a match of at least three game symbols within each game grid.

27. The method of claim 25 wherein the specific interaction between the at least three game symbols in each of the separate game grids is a relationship of at least three game symbols within each game grid, wherein the relationship is determined by color, shape, icon theme, number or letter.

28. The method of claim 25 wherein the at least one multiplier sticker is placed in a designated sticker placement box.

29. The method of claim 25 wherein the at least one multiplier sticker is placed in any slicker placement box.

* * * * *